US005140893A

United States Patent [19]

Leiter

[11] Patent Number: 5,140,893

[45] Date of Patent: Aug. 25, 1992

[54] BLANK FIRING ADAPTER

[76] Inventor: Edward J. Leiter, 355 E. 77nd St. 18B, New York, N.Y. 10021

[21] Appl. No.: 644,828

[22] Filed: Jan. 23, 1991

Related U.S. Application Data

[63] Continuation-in-part of Ser. No. 852,402, Apr. 16, 1986, abandoned.

[51] Int. Cl.[5] ..... F41A 21/26

[52] U.S. Cl. ..... 89/14.5

[58] Field of Search ..... 89/14.2, 14.5, 14.6

[56] References Cited

U.S. PATENT DOCUMENTS

| | | | |
|---|---|---|---|
| 606,115 | 6/1898 | Benet | 89/14.5 |
| 1,416,827 | 5/1922 | Holmes | 89/14.6 |
| 1,445,583 | 2/1923 | Green | 89/14.5 |
| 2,064,503 | 12/1936 | Temple, Jr. | 89/14.6 |
| 2,075,837 | 4/1937 | Studler | 89/14.5 |
| 2,330,210 | 9/1943 | Garand | 89/14.5 |
| 2,339,777 | 10/1943 | Green | 89/14.5 |
| 2,351,037 | 6/1944 | Green | 89/14.5 |
| 2,362,996 | 11/1944 | Green | 89/14.5 |
| 2,714,332 | 4/1955 | Saetter-Lassen | 89/14.5 |
| 2,805,602 | 9/1957 | Moore | 89/14.5 |
| 3,137,204 | 6/1964 | Harvey | 89/14.5 |
| 3,363,509 | 1/1968 | Tschoepe | 89/14.5 |
| 3,369,453 | 2/1968 | Menneking et al. | 89/14.5 |
| 3,411,229 | 11/1968 | Gronemann | 89/14.5 |
| 3,440,924 | 4/1969 | Sawyer | 89/14.5 |
| 3,687,000 | 8/1972 | Csizmar et al. | 89/14.5 |
| 3,732,776 | 5/1973 | Snodgrass | 89/14.5 |
| 3,744,370 | 7/1973 | Snodgrass | 89/14.5 |
| 3,776,093 | 12/1973 | Leverance et al. | 89/14.2 |
| 3,941,029 | 2/1976 | Skahill | 89/14.5 |
| 4,499,811 | 2/1985 | Kaste | 89/14.5 |

FOREIGN PATENT DOCUMENTS

| | | | |
|---|---|---|---|
| 227570 | 10/1962 | Austria | 89/14.5 |
| 419708 | 10/1925 | Fed. Rep. of Germany | 89/14.6 |
| 594740 | 3/1934 | Fed. Rep. of Germany | 89/14.2 |
| 529545 | 11/1921 | France | 89/14.5 |

*Primary Examiner*—Stephen C. Bentley

*Attorney, Agent, or Firm*—Dilworth & Barrese

[57] ABSTRACT

A blank firing adapter having a particular configuration is installed in an automatic or semi-automatic firearm to increase back-pressure of propellant enabling the firearm to be efficiently operated with blank, or practice, ammunition.

3 Claims, 1 Drawing Sheet

FIG. 1
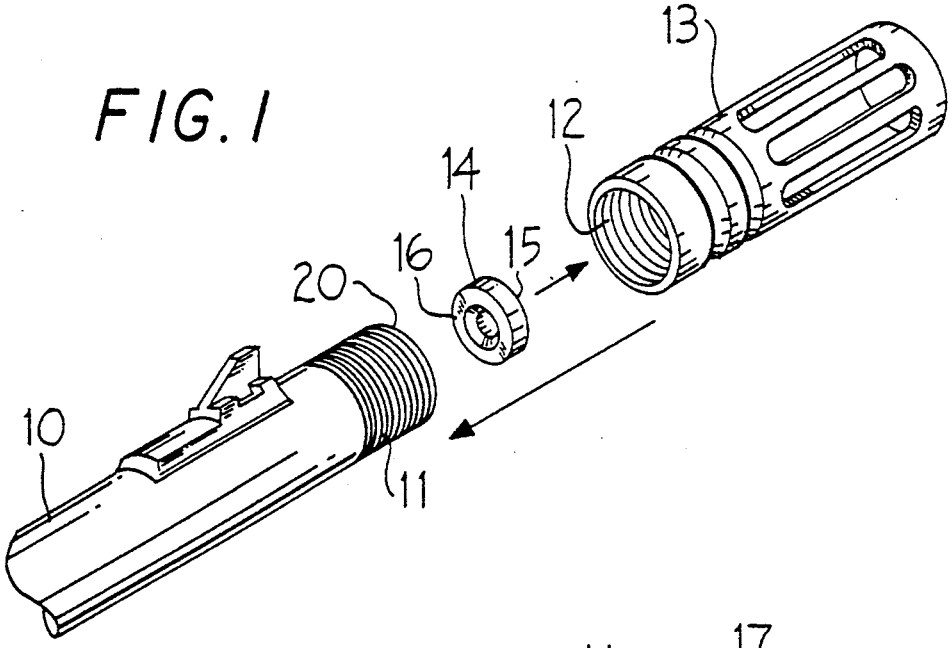
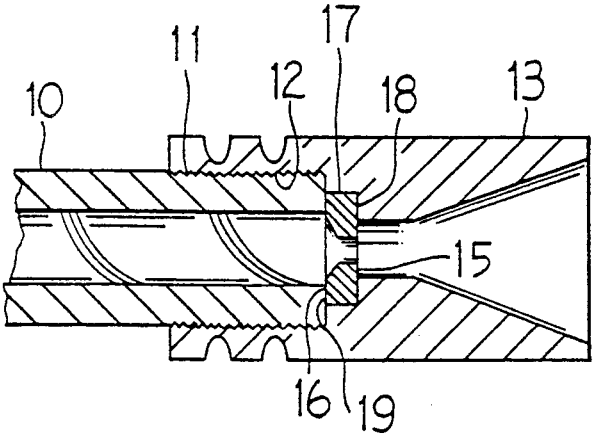
FIG. 2
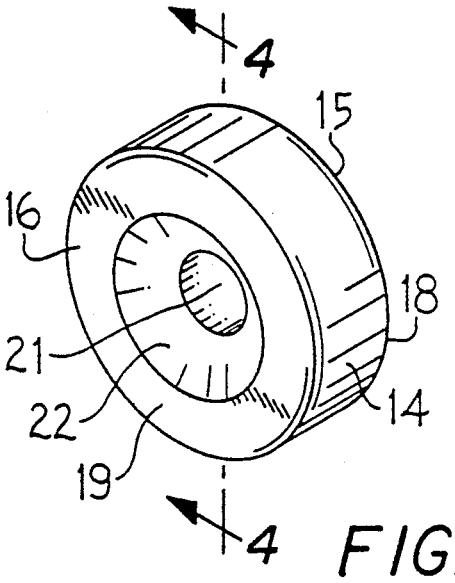
FIG. 3
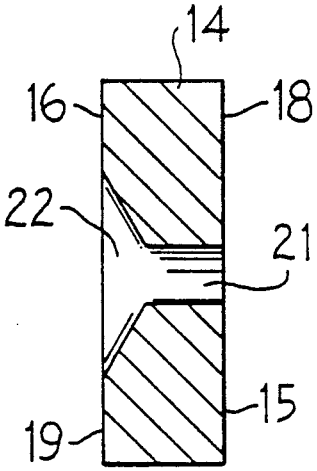
FIG. 4

BLANK FIRING ADAPTER

CROSS REFERENCE TO RELATED APPLICATION

This application is a continuation-in-part of copending U.S. patent application Ser. No. 06/852,402, filed Apr. 16, 1986, now abandoned, and relates to a device for adapting automatic and semi-automatic firearms equipped with a detachable flash suppressor for the firing of blank, or practice, ammunition.

BACKGROUND OF THE INVENTION

In known and conventional automatic and semi-automatic weapons, the back pressure of propellant gas and/or recoil is utilized to effect a complete firing cycle, i.e., extracting a spent cartridge form the firing chamber, ejecting the spent cartridge from the breech, cocking, loading and chambering a fresh cartridge and locking the bolt. When blank, or practice, ammunition is utilized, as would be the case with training operations which are intended to simulate combat conditions or with theatrical, cinematic or other kinds of staged productions where realistic weapon-firing scenes are involved, the relatively low propellant gas pressure and recoil forces are incapable of operating the firearm in the automatic or semi-automatic mode.

In order to overcome this problem, a variety of blank firing attachments or recoil boosters have been provided, the purpose of which is to increase the back pressure of the propellant gas and/or recoil to the point where such pressure and/or recoil force will be sufficient to operate the weapon in the automatic or semi-automatic mode.

An example of a blank firing attachment is described in U.S. Pat. No. 2,075,837, and includes a plug having a central longitudinal bore and flared conical mouth which is screwed into a barrel jacket that has been fitted over the muzzle of the barrel. The plug increases the back pressure of the firearm, a Browning machine gun, to permit the weapon to be automatically operated.

Another example of a blank firing attachment is disclosed in U.S. Pat. No. 3,744,370. A blank firing attachment is installed on a slotted flash suppressor-equipped firearm, the firearm including an externally mounted open frame member fitted at one end to an annular recess defined within a first suppressor. A rod like restrictor is engaged in axial alignment with the bore of the barrel.

A third example of a blank firing attachment is U.S. Pat. No. 2,714,332. This device possesses a recoil amplifier fitted to the barrel of a machine gun. The recoil amplifier includes a gas chamber situated in front of the muzzle at the barrel and closed by a perforated disk.

A fourth example is French Pat. No. 529,545 and includes a plug with a gas-occluding passage therethrough. The plug is held in place against the crown of a gun barrel by a threadedably engagable element. The gas-occluding passage, which terminates in a conical zone defined upon the rear face of the plug, possesses a length which, in the embodiments shown, exceeds the diameter of the plug.

Other blank firing devices similar in operational principle, if not in design, to the preceding arrangements are described in U.S Pat. Nos. 2,330,210, 2,805,602, 3,137,204, 3,363,509, 3,369,453, 3,411,229, 3,440,924, 3,687,000, 3,732,775, 3,941,029 and 4,499,811.

The aforementioned devices are subject to one or more disadvantages which limit their usefulness. For example, they are relatively structurally complex, involve modification of the firearm and/or are not easily or quickly installed. Most of the known devices, i.e., the previously described U.S. Pat. Nos. 3,744,370 and 2,714,332 result in an obvious alteration in the outward appearance of the firearms in which they are installed. While this may not be considered a significant problem for military applications, a firearm having an altered outward appearance is highly disadvantageous where staged entertainments are concerned. In the latter type of situation, any deviation from reality could detract from the verisimilitude of a scene thus impairing its entertainment value.

Another shortcoming of prior art devices is their difficulty in functioning in an effective manner consistent with normal operation of a semi-automatic or automatic weapon, particularly an M-16 rifle. As will be described later in further detail, a series of tests were performed on certain known devices and the present invention to determine the overall effectiveness and operability of each unit. Results of these tests demonstrated that in operation with an M-16 rifle, the present invention is superior over known devices of like construction which experienced severe operating difficulties and excessive temperature and pressure buildups in their units.

SUMMARY OF THE INVENTION

Accordingly, it is a primary object of the present invention to provide a simple, yet highly effective, blank firing adapter for an automatic or semiautomatic firearm, designed to overcome the operational difficulties of known devices.

It is also an object of the present invention to provide a blank firing adapter which can be easily installed in, and removed from, a firearm equipped with a detachable flash suppressor.

Another object of the present invention is to provide a blank firing adapter which is universally applicable to, and particularly adapted for, use with automatic and semi-automatic, flash suppressor-equipped firearms.

Still another object of the present invention is to provide a blank firing adapter for automatic and semiautomatic firearms which is of simple structure, is relatively inexpensive to manufacture, does not require modification of the firearm, and does not alter the outward appearance of the firearm.

A further object of the present invention is to provide a blank firing adaptor extremely effective when used with a M-16 rifle.

In keeping with the foregoing objects and in accordance with the present invention, in an automatic or semi-automatic firearm including a barrel having a bore and a crown, a flash suppressor detachably affixed to the barrel and a blank firing adapter possessing a single propellant gas-occluding passage therethrough which is coincident with the axis of the bore of the barrel, the blank firing adapter being disposed between the crown of the barrel and the flash suppressor, the improvement which comprises a blank firing adapter in which the propellant gas-occluding passage terminates in a conical zone defined upon the rear face of the adapter, the length of the propellant gas-occluding passage being less than the diameter of the adapter.

Installing the blank firing adapter requires no special tools and requires no modification of the firearm or any of its component parts. Installation and removal of the blank firing adapter are accomplished rapidly and easily even by those unskilled or unfamiliar with the firearms. The blank firing adapter provides exceptionally realistic operation of the firearm and maintains substantially the same cyclic rate of fire provided by the firing of conventional ammunition. In a preferred embodiment, the blank firing adapter minimizes fouling through the efficient burning of the propellant charge. The blank firing adapter also minimizes the occurrence of unusual temperature and pressure buildup within the system.

The foregoing advantages individually and collectively result in a firearm adapted for firing blank, or practice, ammunition which is ideally suited for all sorts of situations including those of military and theatrical interest.

BRIEF DESCRIPTION OF THE DRAWINGS

A practical embodiment of the invention is illustrated in the accompanying drawings wherein:

FIG. 1 is an exploded perspective view of a blank firing adapter-equipped firearm herein showing the relationship of the firearm barrel, blank firing adapter and flash suppressor unit to each other;

FIG. 2 is a longitudinal sectional view of the firearm of FIG. 1 showing the installation of the blank firing adapter;

FIG. 3 is an enlarged perspective view of the blank firing adapter showing a conical zone defined upon the rear face thereof; and FIG. 4 is a sectional view of the blank firing adapter of FIG. 3 taken through line 4—4 thereof.

DESCRIPTION OF THE PREFERRED EMBODIMENTS

Referring now to the drawing wherein like reference numerals are used throughout the several figures to designate like parts, barrel 10 is provided with an externally threaded portion 11 at its discharge end, or muzzle, which engages the internally threaded rear chamber 12 of detachable flash suppressor unit 13. Disc-shaped blank firing adapter 14 having front face 15 and rear face 16 is inserted in the rear chamber 12 of flash suppressor 13 with the peripheral edge 18 of its front face 15 coming to rest against shoulder 17 defined within said chamber. Blank firing adapter 14 possesses a single propellant gas-occluding passage 21 therethrough terminating upon rear face 16 in a conical zone 22.

Preferably, blank firing adapter will assume a disc-shape, i.e., a smooth walled cylinder, whose length is less than its diameter, e.g., less than about 60% and preferably less than about 50%, of the diameter of the adapter. For purposes of this invention, the length of propellant gas-occluding passage 21 shall be regarded as excluding the length of conical zone 22. For proper operation of blank firing adapter 14, the length of propellant gas-occluding passage 21 must be less than the diameter of the adapter, preferably less than about 50% and still more preferably less than about 25%, of the diameter of the adapter. In addition, the diameter, or bore, of passage 21 will generally be less than the length of the passage, e.g., less than about 90%, and preferably less than about 75%, of the length of passage 21. Thus, as shown in the blank firing adapter of FIG. 4, the length of passage 21 is somewhat less than about 25% of the diameter of the adapter and the bore of passage 21 is somewhat less than about 65% of its length. The dimensions of conical zone 22 can vary over relatively wide limits, e.g., with the base of the zone, i.e., its diameter at its widest point, being from about 20% to about 60% of the diameter of the blank firing adapter. As will be recognized by those skilled in the firearms art, the optimum dimensions of the blank firing adapter, including its various geometries, will be determined in a given case by several factors including the design and operation of the firearm to be adapted for blank firing, the type of blank cartridge to be fired, the nature of the propellant powder, its loading and similar considerations.

The flash suppressor with blank firing adapter 14 inserted therein is screwed onto the threaded end 11 of barrel 10 until the rear peripheral edge 19 of blank firing adapter 14 abuts crown 20 of the barrel. With this arrangement, the blank firing adapter will be tightly and immovably interposed between the crown of the barrel and the shoulder defined within the threaded rear chamber of the flash suppressor. The width, or thickness, of the blank firing adapter will ordinarily be such as to fill the space remaining between the shoulder of the flash suppressor and the crown of the barrel. Upon reengagement of the flash suppressor with the barrel, the flash suppressor will seat itself fully upon a retaining split-ring lockwasher (not shown) which is conventionally placed over threaded zone 11 of the barrel without loss of engaging thread and will be seized sufficiently by the lock washer to prevent or minimize the possibility of unthreading of the flash suppressor under firing conditions.

In operation, blank firing adapter 14, now completely hidden within the flash suppressor unit of the firearm, provides a gas-occluding restriction of an appropriate magnitude to generate sufficient back-pressure in the barrel with a given type of blank ammunition so that, when the ammunition is discharged, the firearm will be actuated through a complete cycle of operation as previously described; a series of cycles in the case of an automatic firearm and a single cycle in the case of a semi-automatic firearm.

Conical zone 22 defined upon rear face 16 of blank firing adapter 14 receives the expanding propellant gas to initiate its compression. The conical configuration serves more gradually to build up propellant gas back pressure thereby producing a smoother, less abrupt cycle of operation. The gradual reduction in initial pressure occurring between the bolt face of the firearm and the blank firing adapter results in lower burning temperatures at which the propellant powder is consumed, thereby permitting its more even and efficient combustion over a longer period of time. This complements the progressive burning characteristics of the propellant powder and, consequently, leaves significantly less residue or unconsumed powder within the firearm. This results in reduced fouling of the firearm and greater reliability in its operation. Furthermore, whereas the particulate matter of the gas column and burning powder constitute an ejecta possessing both mass and velocity, the back thrust upon the old face and, hence, the firearm, is minimized by the increased surface area of the conical zone upon which this ejecta strikes. This phenomenon reduces the actual recoil force generated upon the mechanism and by diminution of shock, results in more efficient mechanical operation of the firearm.

In addition, the aforedescribed conical zone, in consequence of providing for more efficient combustion of the propellant powder over a longer period of time, permits more nearly complete or complete disintegration and consumption of any wad component as may be present in the blank ammunition, and by providing a channelling surface to the bore path of bore or near-bore diameter, will facilitate ejection of any unconsumed solid wad matter thereby eliminating the necessity for any additional provision within said device for the purpose of dissipating any possible orifice restriction wad component.

Illustrative of firearms which can be advantageously equipped with the blank firing adapter of the invention are the following flash suppressor equipped weapons: M60 0.308 Winchester (7.62 mm NATO) caliber general purpose machine gun; M240 0.308 Winchester (7.62 mm NATO) caliber electrically operated, tank mounted coaxial machine gun; M14 0.308 Winchester (7.62 mm NATO) caliber automatic rifle; and, all other fully automatic, semi-automatic or selective-fire weapons which function on either gas-operated, recoil actuated or blowback principles.

Specifically, for the M16 automatic rifle employing a conventional blank ammunition cartridge of 0.223/5.56 mm caliber, the blank firing adapter can be fabricated from Type 304 stainless steel and can possess a thickness of from about 0.220 to about 0.230 inches, a diameter of from about 0.437 to about 0.0467 inches and a central bore having a diameter of about 0.070 + 0.003 inches. The conical zone defined upon the rear face of the adapter can consists of a cut subtending a thirty degree angle both above and below the radial axis of the disc. The maximum diameter of the cone for this particular example is about 0.244 inches. The peripheral edge of each of the disc's faces can be chamfered slightly to facilitate installation of the adapter in the firearm. While type 304 stainless steel is preferred for its superior resistance to gas erosion caused by the heat of burning propellant powder particles, tool steel or cold-rolled steel can be employed without any adverse effects.

A series of tests were carried out under controlled conditions to evaluate the performance of the blank firing adapter of this invention compared with five blank firing devices fabricated in accordance with embodiments shown or suggested by U.S. Pat. No. 2,714,332, and French Pat. No. 529,545, referred to supra.

I. The Blank Firing Devices

The blank firing devices which were compared were as follows:

Device No. 1 is the blank firing adapter of the present invention constructed specifically for the flash suppressor-equipped U.S. Model M16, 0.223 cal. Automatic Rifle and possessing the dimensions stated above. The material used in its construction, as well as in the construction of the five additional test devices, is alloy steel, oil hardening drill rod of identical composition, and the orifice diameter of all test devices is standardized at diameter 0.1040" in accordance with requisite pressure and operational dictates of the essentially identical blank ammunition loading employed.

Device No. 2 is identical in all regards to Device No. 1, except that the conical zone present in No. 1 is omitted thereby creating a straight through-hole aperture. Device No. 2 represents a disc 14 as described in U.S. Pat. No. 2,714,332.

Device No. 3 represents a plug such as that described in French Pat. No. 529,545. The plug contains both an orifice of 0.1040" diameter and a rear conical zone. However, the external geometries of the device had been constructed such that the passage, or bore, of the plug possesses a length which is at least that of its diameter.

Device No. 4 is a further variant of the plug of French Pat. No. 529,545. The plug contains a bore which is, again, at least the length of the diameter of the plug which seats itself within the inner shoulder of the flash suppressor (which shoulder is in itself identical to the diameter of Device No. 1, as is its width, or thickness), and the remaining requisite length of the plug comprises a rearward extension residing within the bore of the firearm, by the muzzle end, and similarly, possesses a rear conical zone. The section within the bore of the firearm has a slip-fit diameter corresponding to the land diameter of the bore.

Device No. 5 represents yet a still another variant of the plug described in French Pat. No. 529,545. This plug possesses a passage of at least the diameter of the plug, which resides within the inner shoulder of the flash suppressor, ahead of the muzzle of the barrel. Again, that inner plug area within the suppressor is of identical diameter and width, or thickness, as that of Device No. 1, and possesses a like conical zone. The remaining requisite through-bore passage in this case extends into the forward section of the flash suppressor, ahead of the shoulder area of the suppressor, and ends midway into the zone of longitudinal venting cuts milled into that suppressor.

Device No. 6 is a plug constructed in accordance with French Pat. No. 529,545 possessing a passage having a length at least that of its diameter and constructed to seat between the rear shoulder of the flash suppressor and the muzzle of the barrel in a manner similar to that of Device No. 1. Furthermore, this adapter possesses a rear conical zone, as well as a forward conical area as illustrated in FIGS. 3 and 6 of French Pat. No. 529,545. The area of maximum constriction within this device corresponds to diameter 0.1040", as is the case will all the other devices evaluated herein.

II. The Nature of the Testing

The testing herein compared the following:

1. Practicability of physical installation within the flash suppressor element of the firearm.
2. Function of the weapon, including rate of fire, recoil characteristics, and interaction or response of component action assemblies.
3. Ejection of expended ammunition casings, comprising distance and angle of discharge from the ejection port of the weapon. Data collected reflects functional characteristics of the action, as well as derivative pressure and rate of fire indications.
4. Flash and sound characteristics of discharge.
5. Examination of expended ammunition casings for determination of violence of action cycling and chamber pressure evaluation. Pressure evaluations are based upon expansion of cartridge web area, crushing of mid-line cartridge body, back pressure, as indicated by forward area and mid-line crushing of casing, as well as backflow of expanding gases around and toward the rear of the chambered casing, stretch line indications at the web of the casing, and the case head dimension after firing, together with extractor and ejector markings, backflow of metal, and bolt face signature.
6. Condition of adapters after firing.

III. The Testing Methods

The firearm employed for all testing was an SGW/Olympic Model CAR/AR-15, 0.223 cal. rifle which had been fitted with an auto sear assembly and M16 action components, and which, in this configuration, duplicates the U.S. Model M16 Assault Rifle. Blank ammunition was of standard commercial manufacture from the same lot number and possessed a uniform powder charge.

Comparative measurements were made of each round of blank ammunition, both before and after firing, and comprised the following:

1. Micrometer readings of case head diameter.
2. Micrometer readings of case web maximum diameter.
3. Micrometer readings of depth of case seating within an unfired CAR-16 barrel. This measurement represents the distance from the rearward end of the barrel to the case head, and indicates a gauging of case web stretching by determining the remaining space available to seat the cartridge against a fixed point after firing of the ammunition. This data reflects a comparative chambering index that is determined by web stretching.
4. Gauging of mid-case stretching, caused by the crushing effect of backflow gases rearward around the outer area of the cartridge walls, with a reduction of outer diameter of the casings. Measurements were taken by placing both the unfired and fired cases through a size T-opening gauge, 0.3580" diameter, and observing the depth of case seating, and, consequently, the distance of protrusion from the case head to the gauge surface. This data, together with that collected under section 3, above, provides a relative index of case body and case web stretching, thus reflecting an indication of pressure by isolating two areas of case deformation.
5. Gauging of adapter orifice diameter after firing to determine erosion and gas cutting.
6. Micrometer measurement of adapter width (thickness) to determine crushing caused by pressure distribution on the inner (muzzle-abutting) face.
7. Micrometer measurement, in the case of Device No. 4, of the diameter of the conical end, which is slip-fit within the bore of the barrel, to determine pressure resultant crushing of the body, occlusion of the orifice, and gas leak around the circumference of the plug by the muzzle.
8. Physical inspection to determine loosening of the flash suppressor body in its threaded engagement to the muzzle portion of the barrel.
9. Physical examination of expended cartridge casings to determine back pressure crushing of frontal half of casing, rearward gas leakage on outer areas of casing body, case web stretching marks, primer flattening and firing pin impression, case head condition, comprising extractor and ejector markings, bolt face signature impression and rearward metal flow.
10. Physical measurement of distance at which ejected casings struck a fixed platform relative to the ejection port of the weapon, when fired from a constant position and orientation.
11. Measurement by protractor of the angle relative to an imaginary reference line 90 degrees from the ejection port of the weapon at which the expended casings struck the above noted fixed platform when the weapon was fired from a fixed and constant position and orientation.

All casing measurements and comparisons were made on sequentially numbered blanks which were identifiable for pre- and post-fired examination.

Prior to discussing the results of the tests outlined above, it would be helpful toward a better understanding of their significance briefly to explain the principles of interior ballistics which are peculiar to blank ammunition, as well as the characteristic effects such ammunition have on the function of a weapon's action subassemblies.

Whereas with live ammunition the component brass cartridge casing forms a gas seal within the chamber, when under the influence of expanding propellant gases, and exhibits signs of pressure through case stretching rearward by the web area of the casing as the expanding gases create a rearward thrust from inside the case head against the bolt face or breech, blank ammunition demonstrates a slightly more complex series of occurrences. Since blanks are fabricated with an extended forward brass section, sealed by a crimp, which approximates the shape of a projectile, in order to provide the additional cartridge length and taper necessary for repetitive feeding and cycling of the ammunition through the mechanism, a perfect gas seal by the casing against the barrel or chamber walls becomes impossible. Serrations caused by the crimping operation on the brass form tears under the pressure of discharge, and allow propellant gases to surge rearward into the chamber around the cartridge. The greater these pressures are, the greater the effect of crushing the forward, thinner portion of the brass case. The distance rearward on the case where these gases can escape will be in direct proportion to the pressure generated.

Furthermore, since the system still remains a closed one, the same effects of back thrust against the bolt or breech face will occur, and web stretching follows in proportion to the pressure generated. Therefore, while with live ammunition case stretching or deformation will occur primarily in one direction, or at one general area, in blank ammunition case deformation occurs in two distinct regions.

An examination of the interior ballistics of live ammunition at the muzzle of the firearm indicates that the cumulative, increasing gas volume, which is maintained under high pressure by the plug effect of the projectile within the bore, is suddenly released by the exiting of the projectile from the barrel. Thus, although in gas-operated firearms the cycling of the mechanism has already been initiated by the bleeding of gas from the bore near the muzzle, through transmission of a portion of this gas to the bolt assembly, the remaining high pressure within the barrel and chamber has instantaneously been reduced to low levels by the time the locked breech mechanism has begun its rearward travel, since the projectile/plug has, in a relative sense, long exited the system.

In a firearm which relies upon the restriction of a blank adapter to generate sufficient pressure within the system to initiate the cycling operation, gas pressures exist more sustainedly, since only a small portion of these expanding gases can escape the muzzle of the weapon through the restricted opening. Consequently, while the diverted gases have caused unlocking and rearward travel of the bolt assembly, relatively high pressure is maintained within the barrel, and produces back thrust against the receding bolt. In cases of extreme pressure, web stretching of the case becomes more apparent, and the cartridge case itself becomes a piston which slams against the reciprocating bolt face. This phenomenon can produce violent cycling of the action, and will noticeably effect the rate of fire and all attendant occurrences.

IV. The Test Results

The test data presented herein corresponds to the bases for comparison enumerated in Section III, supra. The test data were based upon the results obtained from a representative group of ten rounds of blank ammunition fired in the full automatic mode with each of Devices 1–6 installed. Confirming observations in each case was obtained from an average of an additional thirty rounds discharged through each adapter.

Device No. 1

1. Installation of adapter of nominal 0.2324" thickness within the suppressor element provided maximum thread engagement of suppressor with muzzle of firearm, and secure coupling with retaining lock washer.

2. Rate of fire averaged approximately 500 rounds per minute, and recoil characteristics remained mild and controllable, with no indications of undue violence with the interaction of reciprocating subassembly elements.

3. Ejected casings fell 45" from the ejection port of the weapon, and exited rearward of the midpoint of the ejection area at a 26-degree angle from an imaginary line perpendicular to the receiver at that point.

4. Flash characteristics at the muzzle defined a starburst pattern of flame around the circumference of the suppressor, through the longitudinal milled slots, accompanied by a pencil flame at the forward portion of the suppressor which extended approximately 30" from the weapon.

5. Average 10-shot increase in web thickness of the expended casings was 0.0025" per case. Average chambering index, as described in section 3 of "Testing Methods," was 0.0133". This figure reflects the rearward displacement of the case head through stretching of the web area. Examination of this figure reveals that the higher the Chambering Index, the greater the remaining space that exists between a fixed datum line reference point within the gauging chamber and a fixed vantage point from which measurements are taken, and consequently, the smaller the amount of rearward web stretching of the case as the results of combustion pressure. Average mid-case crushing due to rearward escape of propellant gases around the outer surface of the cartridge case revealed an index of 1.104" as measured from the case head to the surface of the size T-opening gauge, as described in section 4 of "Testing Method." Note that the higher the Mid-case Index, the greater the area of the casing that is unaffected by a given pressure, and, consequently, the smaller the crushing effect of back pressure generated within the chamber. The average Web Line Distance was 0.2717". This figure represents the distance from the case head to the demarcation point forward on the case where stretch marks become visible. Note that as pressure increases this mark recedes further toward the rear of the case. Thus, the smaller the index, the greater the pressure indications as the stretch marks are moved further to the rear.

Extractor and ejector marks on the case head were minimal. Indication of gas leakage, due to mid-case crushing, demonstrate leakage to only one-third of the distance rearward form the front of the expended cartridge case. No backflow of metal on the case head was visible, nor was any bolt face signature apparent.

6. After being subject to discharge pressures the adapter retained its full thickness of 0.2324", thus demonstrating no high pressure crushing or deformation. No erosion or high pressure gas cutting was apparent at the conical zone or through-passage, even under microscopic examination. The passageway retained its original diameter of 0.1040".

7. From the data presented above, it is evident that operation of the firearm is normal and that no excessive or demonstrably unusual pressures are generated. Examination of test casings reflect dimensional changes consistent with normal behavior of, and pressure ranges generated by, propellant powders when employed in a blank-firing mechanism. The observations and inferences drawn from the performance of Device No. 1 represented the control against which subsequent testing of the Devices 2–6 were compared.

Device No. 2

1. Physical installation of this adapter was accomplished in a similar manner to that of the previous device. Adapter thickness upon installation was 0.2300".

2. Rate of fire increased slightly to approximately 550 rounds per minute. Felt recoil was also somewhat augmented, with commensurate increase in perceptible motion of reciprocating bolt components.

3. Ejected shell casings were discharged to a distance of 76" from the weapon, and travelled rearward at only a 5-degree angle, thus placing them almost perpendicular to the ejection port.

4. Flash characteristics were similar to those of Device No. 1. However, the pencil flame at the muzzle extended an additional 4" from the weapon. Sound level was elevated above that of the previous device.

5. Average increase in web thickness of recovered cases was 0.0013". Average Chambering Index was 0.0155". Mid-case Index averaged 1.094", and the average Web Line Distance was 0.2559". Extractor and ejector markings were more pronounced than in Device No. 1, and the periphery of the case head indicated slight rounding of the edges, thus inferring incipient metal flow. Rearward back flow of gases, due to case crushing, reached midway down the length of the expended cartridge.

6. Examination of the adapter indicated visible compression of the rear, bore-abutting surface where the conical zone was omitted. Micrometer readings revealed a thickness in this area of 0.2275", thus demonstrating a compression factor of 0.0025" after discharge of only ten rounds. Furthermore, visible high temperature gas erosion signs were evident around the periphery of the rear through passage opening, indicating both temperatures adequate to melt the steel plug, and pressure sufficient to drive the molten steel particles into the orifice.

7. Test data indicates that lack of the conical zone created extreme temperatures and pressures within the system. Increase of 0.0010" in the case head diameter suggests relatively high pressure, and mid-case crushing accounts for a reduction in the Mid-case Index, since a greater portion of the case could be fit through the T-gauge. Decrease in the Web Line Distance from the case head implies sufficient pressure to force the web stretch mark further toward the rear.

Device No. 3

1. This device proved impracticable for testing purposes, since the geometries suggested, i.e., a through-passage (and, thus, an overall length) of at least the diameter of the plug, produced an adapter whose length occupies almost the entire inner area of the flash suppressor into which it must sit. The consequent remaining thread engagement area of 2 to 3 threads would not provide sufficiently secure attachment to the barrel of the weapon. In fact, such a configuration would be unsafe, since initial discharge of the firearm would blow the suppressor unit, with adapter, off the barrel, and create a high velocity projectile. No further analysis of this variant seems indicated.

Device No. 4

1. Installation of this adapter entailed a slip-fit within the bore of the firearm, and retention by means of a shoulder within the flash suppressor. Lock nut engagement was full, since the geometries of the suppressor-contained portion were similar to those of Device No. 1.

2. Rate of fire was noticeably reduced with this device, and fell to approximately 425 to 450 rounds per minute. In addition, violent recoil was experienced, together with suggestive increase of volume and sharpness of report. Individual discharges became more distinct, and the overall effect could be likened to that of a pom-pom gun.

3. Ejected cases fell 75" from the ejection port of the weapon, and were thrown at only a 5-degree rearward angle.

4. Flash characteristics at the muzzle were more radially pronounced, and the pencil frame was reduced noticeably in length.

5. Average case head expansion was measured to be 0.0033". Average web stretching was 0.0010", and the Chambering Index indicated a reduction to 0.0152", thus suggesting increased web stretching under pressure. Midcase Index from gas crushing was 1.078", in accord with the rearward gas flow distance, which now encompassed two-thirds of the case length. The Web Line Distance was reduced to 0.2594", indicating augmented stretching characteristics by the web juncture.

Metal flow at the edges of the case head was significantly pronounced, and signs of bolt face impression were becoming visible. Similarly, ejector and extractor markings were more apparent.

6. Examination of the device demonstrated gas leakage around the periphery of the conical zone contained within the bore. This gas leak had, consequently, crushed the conical zone area, reducing its diameter from 0.2189 to 0.2180" after discharge of ten rounds. Gas erosion was in evidence at areas of the conical zone rear face. Furthermore, the adapter had been driven slightly forward within the suppressor unit, suggesting that extremely high tolerance fit would be necessary in production of this device to ensure stability within the flash hider.

7. Increased length of the through-passage in this device delays the expulsion of propellant gases from the bore, thus creating high pressure characteristics within the system. Both the distance and angle of case ejection supports the conclusion that the weapon is functioning with elevated violence in the cycling of its action. This phenomenon is so pronounced in the almost perpendicular angle of ejection, that it suggests bolt motion fast enough to strike the ejecting cases by the already closing bolt assembly before the cases have fully cleared the breech. Alteration in sound characteristics of the report suggest an abrupt extraction of fired cases from the chamber, which phenomenon is caused by the prolonged period of high barrel and chamber pressure, thus driving the casing piston-like against the opening bolt. The suddenness of this blow augments bolt velocity, which occurrence would substantiate the inferences drawn from observation of case ejection distance and angle. The distinct possibility exists of failure of the device, due to occlusion of the adapter orifice by the crushing effect of gases around the conical zone within the bore.

Device No. 5

Behavior of Device No. 5 substantially duplicates that of the previous test, in consequence of the long passageway in the adapter. However, since in this device a more efficient barrel seal is achieved by the reversal of the configuration of the geometries applied, the violence of cycling of the weapon, as well as the sound and flash characteristics, are further augmented.

| Test data figures are as follows: | |
|---|---|
| Average Case Head Increase: | .0073" |
| Average Web Increase: | .0009" |
| Average Chambering Index | .0583" |
| Average Mid-case Index: | 1.074" |
| Average Web Line Distance: | .2603" |
| Distance of Case Ejection | 62" |
| Angle of Case Ejection: | 11-degrees |

Device No. 6

1. Installation of this device, which duplicates that of French Pat. No. 529,545, is based upon such geometries that permit only marginal thread engagement of the flash suppressor to the muzzle area of the barrel. In consequence, no contact is made between the suppressor and the securing lock washer ring, and this device cannot be safely secured to the firearm. Although such was the prohibition against testing Device No. 3, thread engagement here was approximately one-third inch, and limited testing could be conducted.

2. Approximate rate of fire was 450 to 500 rounds per minute, and recoil effects were perceptible as being greater than those of Device No. 1, though somewhat less violent than those experienced with Device Nos. 4 and 5. However, the concussive shock of firing rendered the suppressor dangerously loose at the muzzle after ten rounds of discharge, and had to be retightened for subsequent testing.

3. Ejected casings fell 48" from the weapon, and travelled rearward at a 19-degree angle. This would indicate a less violent action than that of devices 4 and 5, though more violent than the operation of Device No. 1.

4. Flash characteristics tended toward a thicker, widening flame at the end of the barrel, with diminished peripheral star pattern through the suppressor slots. This must be regarded in light of the conical nozzle-like opening at the forward extremity of the adapter, which produces a jet effect uncharacteristic of firearm muzzle signature.

5. Average case head diameter was reduced by 0.0015" in fired cases due to deformation of portions of the rim and head areas by the action of the extractor claw. Average web diameter increased 0.0037"; Chamber Index remained at 0.3043, while the Mid-case Index was 1.080:, reflecting crushing by backflow gases. The Web Line Distance was 0.2036", which corroborates previous data suggesting high pressure conditions.

Backflow gases covered two-thirds of the surface of the cartridge case, and metal backflow was visible at the peripheral edge of the case head.

6. Examination of the adapter after firing revealed gas erosion at the inner portion of the conical zone at the area where the converging internal surfaces reach their maximum constriction.

7. The adapter proved unsuitable, and unsafe, for repetitive firing purposes, since engagement of the suppressor housing element to the barrel was marginal. However, indications are that, could sustained fire be safely effected, erratic operation would result due to erosion and alteration of the orifice diameter. Sound characteristics and recoil sensation suggest higher than normal pressures for such a blank-firing system, as do case measurements. Once again, the extended length of the adapter orifice, though severely constricted in only one point at the mid-section, prolongs the high pressure time of gases confined within the barrel, even though the adapter through-passage is flanked by graduated conical apertures.

Results of the above testing indicate that blank adapters employed in gas operated weapon systems achieve optimum effectiveness only by incorporation of a conical zone. In addition, the data show that when the length of the through-passage of the adapter is increased relative to the diameter of the adapter, whether as a tapered aperture, or as a straight channel, pressure dissolution within the chamber and bore are not synchronous with the reciprocation of the breech assembly and violent discharge and battering of breech components can result. A threshold length of the adapter through-passage must, however, be arrived at to preclude the erosion of the orifice periphery as well as the effects of jet-like expulsion of propellant gases at the muzzle. Of the six devices examined, Device No. 1 operates in the most efficacious manner consistent with normal firearm design and operation.

The above embodiments have been shown and described only as examples of the present invention, and other modifications and embodiments are contemplated within the spirit and scope of the present invention as defined by the following claims.

What is claimed is:

1. In an automatic or semi-automatic firearm including a barrel having a bore and a crown, a flash suppressor detachably affixed to the barrel and a blank firing adapter possessing a single propellant gas-occluding passage therethrough which is coincident with the axis of the bore of the barrel, the blank firing adapter being disposed between the crown of the barrel and the flash suppressor, the improvement which comprises a blank firing adapter in which the propellant gas-occluding passage terminates in a conical zone defined upon the rear face of the adapter, the length of the propellant gas-occluding passage being less than 25% of the diameter of the adapter and the diameter of the propellant gas-occluding passage being less than 90% of its length, there being no unrestricted passage of exiting propellant gas from the barrel of the firearm except through the gas-occluding passage of the blank firing adapter.

2. The automatic or semi-automatic firearm of claim 1 in which the body of the blank-firing adapter is cylindrical.

3. The automatic or semi-automatic firearm of claim 1 in which the diameter of the propellant gas-occluding passage is less than about 75% of the length of the passage.

* * * * *